US011064755B1

(12) United States Patent
Williams et al.

(10) Patent No.: US 11,064,755 B1
(45) Date of Patent: Jul. 20, 2021

(54) SAFETY HELMET

(71) Applicant: JSP LIMITED, Witney (GB)

(72) Inventors: Mark Williams, Oxford (GB); Andrew Roberts, Oxford (GB)

(73) Assignee: JSP LIMITED, Oxford (GB)

( * ) Notice: Subject to any disclaimer, the term of this patent is extended or adjusted under 35 U.S.C. 154(b) by 0 days.

(21) Appl. No.: 17/271,408

(22) PCT Filed: Aug. 16, 2019

(86) PCT No.: PCT/GB2019/052310
§ 371 (c)(1),
(2) Date: Feb. 25, 2021

(87) PCT Pub. No.: WO2020/044020
PCT Pub. Date: Mar. 5, 2020

(30) Foreign Application Priority Data

Aug. 30, 2018 (GB) ..... 1814133
Jun. 14, 2019 (GB) ..... 1908593

(51) Int. Cl.
*A42B 3/22* (2006.01)
*A42B 3/18* (2006.01)

(52) U.S. Cl.
CPC ..... *A42B 3/225* (2013.01); *A42B 3/185* (2013.01); *A42B 3/223* (2013.01)

(58) Field of Classification Search
CPC ..... A42B 3/225; A42B 3/185; A42B 3/223
See application file for complete search history.

(56) References Cited

U.S. PATENT DOCUMENTS 2,204,688 A 6/1940 Mcclung
2,834,017 A 5/1958 Simpson
D199,931 S 12/1964 Kline
(Continued)

FOREIGN PATENT DOCUMENTS

DE 202006000930 U1 5/2006
DE 202019001099 U1 6/2019
(Continued)

OTHER PUBLICATIONS

Head and eye protection become one with JSP (on-line), dated Oct. 25, 2019. Retrieved from Internet Mar. 25, 2020, URL: https://www.hsmsearch.com/Head-eye-protection-become-one-JSP (1 page) ( Year: 2019).

(Continued)

*Primary Examiner* — Khaled Annis
(74) *Attorney, Agent, or Firm* — Trevor T. Graves; King & Schickli, PLLC

(57) ABSTRACT

A protective helmet comprising a head mountable shell (10) and a transparent visor (24), the head mountable shell defining a rear portion and an opposing front portion (12) when oriented for use, the front portion being recessed, the helmet further comprising a cover portion (16) mountable over the recessed front portion so as to define a cavity, the transparent visor being pivotally mounted across the recessed front portion by means of a pair of pivot mechanisms (28), the pivot mechanisms being located at opposing sides of the recessed front portion and substantially wholly within the cavity, and configured to enable the transparent visor to be pivoted from a first position substantially within the cavity to a second, operable position generally perpendicular to a user's eyeline.

6 Claims, 10 Drawing Sheets

(56) References Cited

U.S. PATENT DOCUMENTS

| | | | |
|---|---|---|---|
| 3,594,816 | A | 7/1971 | Webb |
| 3,720,956 | A | 3/1973 | Raschke |
| 3,822,698 | A | 7/1974 | Guy |
| 4,726,074 | A | 2/1988 | Baclit et al. |
| 4,766,609 | A | 8/1988 | Lane |
| 5,283,914 | A | 2/1994 | James |
| 5,555,570 | A | 9/1996 | Bay, Jr. |
| 5,901,369 | A | 5/1999 | Pilney |
| 6,375,865 | B1 | 4/2002 | Paulson et al. |
| 6,609,913 | B1 | 8/2003 | Batts |
| D541,991 | S | 5/2007 | Lawrence |
| D542,979 | S | 5/2007 | Himmele |
| D631,612 | S | 1/2011 | Tajima |
| 8,117,676 | B1 | 2/2012 | Cardoso |
| D667,590 | S | 9/2012 | Williams |
| 8,484,767 | B2 | 7/2013 | Nakayama |
| D690,882 | S | 10/2013 | Nowikow et al. |
| D707,894 | S | 6/2014 | Mehra et al. |
| D742,598 | S | 11/2015 | Peng |
| D743,630 | S | 11/2015 | Peng |
| D748,866 | S | 2/2016 | Tutor |
| D756,568 | S | 5/2016 | Scanlon |
| D776,749 | S | 1/2017 | Cummings et al. |
| 9,554,613 | B2 | 1/2017 | Tutor |
| 9,993,044 | B2 | 6/2018 | Garcia |
| D846,809 | S | 4/2019 | Shimano et al. |
| D846,810 | S | 4/2019 | Akrapovic |
| D871,405 | S | 12/2019 | Denhez et al. |
| D907,859 | S | 1/2021 | Williams |
| D907,860 | S | 1/2021 | Williams |
| 2007/0016998 | A1 | 1/2007 | Reddington |
| 2008/0092342 | A1 | 4/2008 | Chen |
| 2011/0271429 | A1 | 11/2011 | Nakayama |
| 2011/0277224 | A1 | 11/2011 | Okuma |
| 2012/0185989 | A1 | 7/2012 | Higgins |
| 2018/0242679 | A1 | 8/2018 | Johnstone |
| 2019/0365009 | A1 | 12/2019 | Frieder |

FOREIGN PATENT DOCUMENTS

| | | | |
|---|---|---|---|
| EP | 0290293 | A1 | 5/1988 |
| EP | 0668029 | A1 | 2/1995 |
| EP | 2554067 | A1 | 2/2013 |
| GB | 2402319 | A | 12/2004 |
| GB | 4015577 | | 5/2010 |
| GB | 2513831 | A | 11/2014 |
| GB | 2544686 | A | 5/2017 |
| JP | 2003082518 | A | 3/2003 |
| JP | 2003253519 | A | 9/2003 |
| KR | 301045059.0000 | | 2/2020 |

OTHER PUBLICATIONS

EVO VISTAsheild—White (on-line), no date available. Retrieved from Internet Mar. 24, 2020, URL https://www.jspsafety.com/link/en/head-protection/evo-vista-/evo-vistashield-/evo-reg-vistashield-trade-white-white/amc170-004-f00/p/?parm=CAT1JSP&prdcod=AMC170-004-F00(1 page).

SAFETY HELMET

FIELD OF THE INVENTION

This invention relates generally to a safety helmet and more particularly to a safety helmet having an integrated eye-shield or face-shield, whether removable or otherwise.

BACKGROUND OF THE INVENTION

Operatives working in potentially hazardous environments such as construction sites and the like are required by statute in most jurisdictions worldwide to wear a safety helmet or "hard hat" to prevent severe head trauma in the event of an accident. Numerous different types of such safety helmets are widely known and extensively used throughout various industries.

For some activities, where there is a risk of facial injury or eye protection is required, an operative may wear a safety helmet comprising a helmet shell and a transparent visor mounted on the helmet shell so as to be movable from a raised/stowed position to a lowered operable position over the user's eyes or face, substantially at a right angle to the users eyesight.

Many different such visor-equipped helmets are known and widely used. For example, opposing pivot pins may be mounted on respective sides of a helmet shell, and engage with opposing side edges of a transparent visor such that it can be pivoted up and down as required.

Various forms of mountings for visors have been proposed previously. DE 202006000930 U (VOSS HELME GMBH) 20 Apr. 2006 describes a protective helmet comprising a two-part helmet shell having a front part and a rear part, together forming the shell, wherein the front part covers a cavity immediately beneath it. A visor is slidably mounted relative to the cavity by means of a pair of arms extending from the upper edge thereof which engage with a respective pair of rails. The visor can then be moved from its upper position (within the cavity) to its lower position (over the user's face) without the need for pivot pins or any other moving parts. EP 066029 A (SOCIETE DE NEGOCE ET D'ACAHTS DE MATERIAUX DE L'OUEST) 23 Aug. 1995 discloses a visor of a helmet that is articulated on two lateral plates which slide in two opposite slides on the inner lateral walls of the helmet. The lower end of each slide is level with the lower edge of the helmet. A stud on each plate engages in a window in the slide and locks the plate automatically in its position for use. The visor is removed by sliding the plates down manually. The visor is articulated on each plate by two rods, the upper rod being joined to the plate by a spring. JP 2003082518 A (TANIZAWA SEISAKUSHO LTD) 19 Mar. 2003 discloses a helmet provided with a face shield in a helmet shell body. In the helmet, an arc-shaped guide part is formed on the surface of the forehead part of the helmet shell body to guide a sliding member provided in the nearly central part of the face shield. U.S. Pat. No. 5,283,914 A (COAL INDUSTRY PATENTS LTD) 8 Feb. 1994 discloses a protective helmet incorporating a visor retractable therewithin, a fan for providing filtered airflow through a duct within the shell to the visor, and ear defenders mounted substantially within the profile of the shell. EP 0290293 A (HELMETS LTD) 9 Nov. 1988 discloses a helmet, particularly an aircrew helmet, having a rear part and a front part. The rear part comprises a shell shaped to extend partially over the top of the wearer's head and to each side of the head. The front part is shaped to fit against the rear part to complete the shell of the helmet, and is detachably connected to the rear part. The front part is shaped to accommodate equipment for optical protection or enhancement, such as a visor or night vision goggles. A single helmet may have two or more interchangable front parts with different optical equipment. The front part may be connected to the rear part by releasable catches at the top and sides of the helmet. The catch at the top may allow the front part to pivot upwards to enable the helmet to be donned and doffed without detaching the front part. EP 2554067 A (OPTICOS SRL) 6 Feb. 2013 discloses safety helmet of the type comprising an outer shell, provided with a front opening, coupled with an inner shell made of shock absorption material, at least one anti-dazzle visor constrained to the outer shell and movable between at least one position of engagement with the front opening and a position of disengagement from this latter, and an operating portion of the anti-dazzle visor, integral with this latter, and controlled, through at least one motion transmission cable, by a control slider coupled slidingly to a related guide fastened to the outer shell. This control slider is translatable manually between an inactive position in which the anti-dazzle visor is arranged in its position of disengagement and an active position in which the anti-dazzle visor is arranged in its aforesaid at least one position of engagement.

However, there is an ongoing desire to improve the comfort and ease of the use of such equipment. Furthermore, there is a need to enable a user's prescription eyewear and/or nose to be comfortably accommodated behind the visor in use. Still further, it would be desirable to provide an integrated visor helmet that does not require any holes in the body of the helmet shell to accommodate fixings, thereby enabling the equipment to comply with the 'electrical resistance' requirements of a jurisdiction, for example, BSI standard BS:EN397:2012.

Aspects of the present invention seek to address at least some of these issues.

SUMMARY OF THE INVENTION

One aspect of the invention provides a safety helmet, comprising:

- a head mountable shell defining a rear portion and a recessed front portion;
- a cover portion for mounting over the recessed front portion so as to define a cavity; and
- a transparent visor mounted on the shell so as to be movable between a first position substantially within the cavity, and a second, operable position substantially at right angles to a user's eyeline;
- wherein the visor is mounted across the recessed front portion by pivot mechanisms located at opposite sides of the recessed portion within the cavity; and each pivot mechanism comprises a pair of elongate cam tracks defined in a plate mounted in the recessed portion, and a pair of projections on the surface of the visor, such that each projection engages a corresponding cam track so as to slide along the corresponding cam track when the visor is moved between the first and second positions.

The pair of elongate cam tracks can be aligned so as to extend downwardly from near an upper end of the plate at an incline to the vertical, towards a lower end of the plate. The pair of elongate cam tracks can comprise a first cam track laterally spaced forward of a second cam track. The cam tracks can extend alongside each other and can be longitudinally offset such that a lower end of the first track is closer to the lower end of the plate than the lower end of the second track, and an upper end of the second track is closer to the upper end of the plate than the upper end of the first track. The first track can have a radius of curvature that is greater than that of the second track. The first track can comprise an angled portion at its lower end. The angled portion can include one or more notches defining stop points for the corresponding projection to define predetermined rake angles of the visor when in the second position.

The plate of each pivot mechanism can be removably mounted in the recessed portion.

Another aspect of the invention provides safety helmet, comprising:

- a head mountable shell defining a rear portion and a recessed front portion;
- a cover portion for mounting over the recessed front portion so as to define a cavity; and
- a transparent visor mounted on the shell so as to be movable between a first position substantially within the cavity, and a second, operable position substantially at right angles to a user's eyeline; wherein the visor is mounted across the recessed front portion by pivot mechanisms located at opposite sides of the recessed portion within the cavity; and each pivot mechanism comprises a pair of arms comprising an upper arm and a lower arm, and each arm is pivotally fixed at one end within the recessed portion, and at the opposing end to the visor;

wherein the lower arm is telescopic to allow for extension or contraction extendable when the visor is moved between the first and second positions.

The upper arm can be fixed in length. The lower arm can be telescopic when the visor is in the second position so as to allow adjustment of the rake angle of the visor when in the second position.

The pivot mechanism can comprise a positive locking means for positively locking the visor in the second, operable position.

The visor can comprise a gripping portion which extends from the cavity when the visor is in the first position.

The safety helmet can further comprise a card holder having a mount fixedly mounted, via non-invasive means, on the outer surface of the safety helmet, and a removable cover received within the mount, the cover defining a gap or space to receive an identity card. The mount can be fixed on the front cover portion of the safety helmet, for example by a weld such as an ultrasonic weld.

Another aspect of the invention provides a method of manufacturing a safety helmet front cover portion for use with the safety helmet, wherein the safety helmet comprises a card holder, the method comprising:

a. forming a front cover portion shaped and configured to be mountable over a recessed portion of the shell of the safety helmet, the front cover portion having a convex outer surface and a concave inner surface, and b. welding a card holder to the outer surface of the front cover portion.

Step b. can further include ultrasonically welding a card holder to the outer surface of the front cover portion.

Another aspect of the invention provides a card holder for use on a safety helmet, the card holder providing a mount to be mounted on an outer surface of a safety helmet, and a removable cover received within the mount, the cover defining a gap or space to receive an identity card.

The card holder can comprise:

a mount for mounting on an outer surface of a safety helmet, and a removable cover received within the mount, the cover defining a gap or space to receive an identity card;

wherein:

the mount comprises a generally rectangular frame defining a generally rectangular window, the frame having sockets in its side edges and lower edge; and the cover comprises a rectangular part comprising a window between its edges and engagement means protruding from its side edges and lower edge, the position of the engagement means corresponding to the position of the sockets in the side edges and lower edge of the frame of the mount, the cover further comprising a double wall structure having a front wall spaced apart from a rear wall to define a gap for receiving a card carrying information to be viewable through the window, a side wall connecting the side and top edges of the front and rear walls with an opening along the lower edge of the cover via which the card may be placed within the gap.

The engagement means protruding from the lower edge of the cover can comprise a lip configured to engage with an aperture comprising the socket in the lower edge of the frame.

The mount and the cover can be curved to follow the profile of the helmet.

These and other aspects of the invention will be apparent from the following detailed description.

DETAILED DESCRIPTION

Figure 1A:
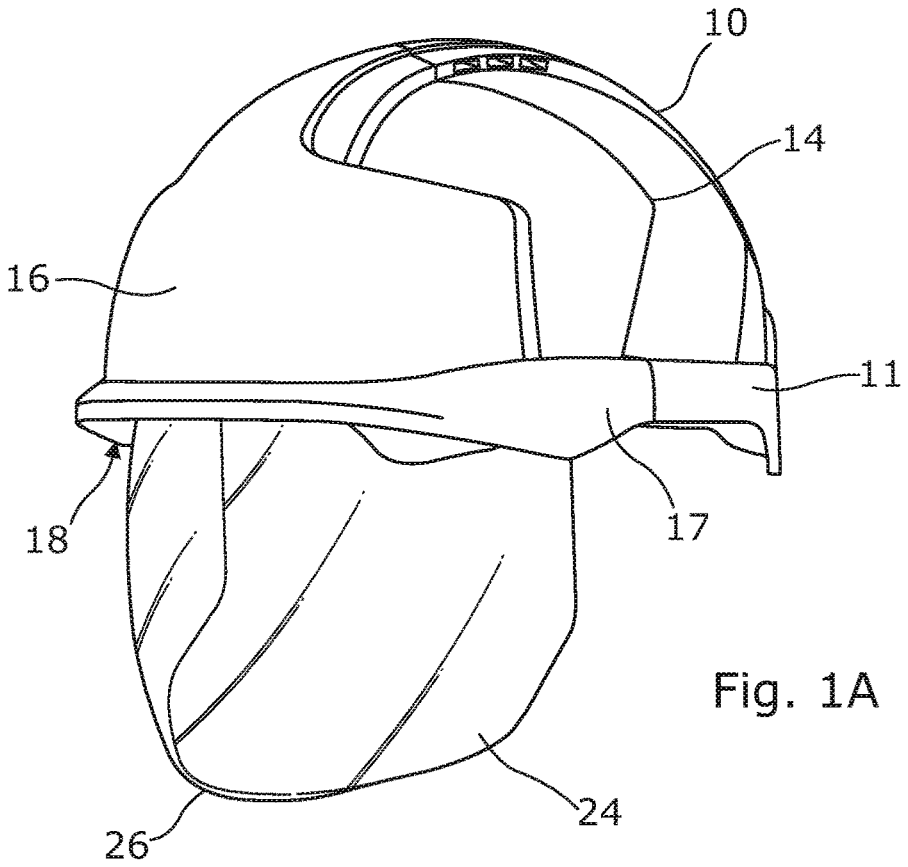
FIG. 1A is a perspective view of a safety helmet having an integrated visor.

Examples of a first aspect of the invention comprise a protective helmet comprising a head mountable shell and a transparent visor, the head mountable shell defining a rear portion and an opposing front portion when oriented for use, the front portion being recessed, the helmet further comprising a cover portion mountable over the recessed front portion so as to define a cavity, the transparent visor being pivotally mounted across the recessed front portion by means of a pair of pivot mechanisms, the pivot mechanisms being located at opposing sides of the recessed front portion and substantially wholly within the cavity, and configured to enable the transparent visor to be pivoted from a first position substantially within the cavity to a second, operable position generally perpendicular to a user's eyeline.

In accordance with one exemplary embodiment of the present invention, the pivot mechanism may comprise a positive locking means for positively locking the visor in the operable position.

Optionally, each of the pivot mechanisms may be a cam track pivot mechanism comprising a plate having at least one elongate track therein configured to slidably engage with at least one corresponding projection on the surface of the visor. The cam track pivot mechanism may comprise a pair of elongate tracks therein configured to slidably engage with the visor.

According to an exemplary embodiment of the invention, the elongate track(s) may be aligned so as to extend from near an upper edge of the pivot mechanism downwardly at an incline to the vertical.

Optionally, the foremost elongate track may comprise an angled portion at its lower end.

In an exemplary embodiment of the invention the pivot mechanism may comprise a pair of arms pivotally fixed at one end within the cavity and pivotally fixed at the opposing end to the visor. Optionally, the lowermost arm may be extendable.

The visor may be curved along its longitudinal axis.

The visor may be curved laterally.

In an exemplary embodiment of the invention the visor may comprise a gripping portion which extends from the cavity when the visor is in the retracted position. Optionally, the visor can be tilted when in the operable position.

The visor may comprise a faceshield. Alternatively, the visor may comprise an eyeshield. The eyeshield may comprise a nose bridge portion.

In one exemplary embodiment of the invention, the safety helmet may further comprise a card holder having a mount fixedly mounted, via non-invasive means, on the outer surface of the safety helmet, and a cover configured to be removably received within the mount, the cover comprising a gap configured to receive an identity card.

Optionally, the mount is fixed on the front cover portion of the safety helmet.

The mount is fixedly mounted on the outer surface of the safety helmet by a weld. Optionally, the mount is fixedly mounted on the outer surface of the safety helmet by an ultrasonic weld.

Examples of a second aspect of the present invention comprise a method of manufacturing a safety helmet front cover portion for use with the safety helmet of any of the preceding claims wherein the safety helmet comprises a card holder, the method steps comprising:

a. forming a front cover portion shaped and configured to be mountable over a recessed portion of the shell of the safety helmet, the front cover portion having a convex outer surface and a concave inner surface, and b. welding a card holder to the outer surface of the front cover portion.

In accordance with one exemplary embodiment of the present invention, step b. may further include ultrasonically welding a card holder to the outer surface of the front cover portion.

Figure 2:
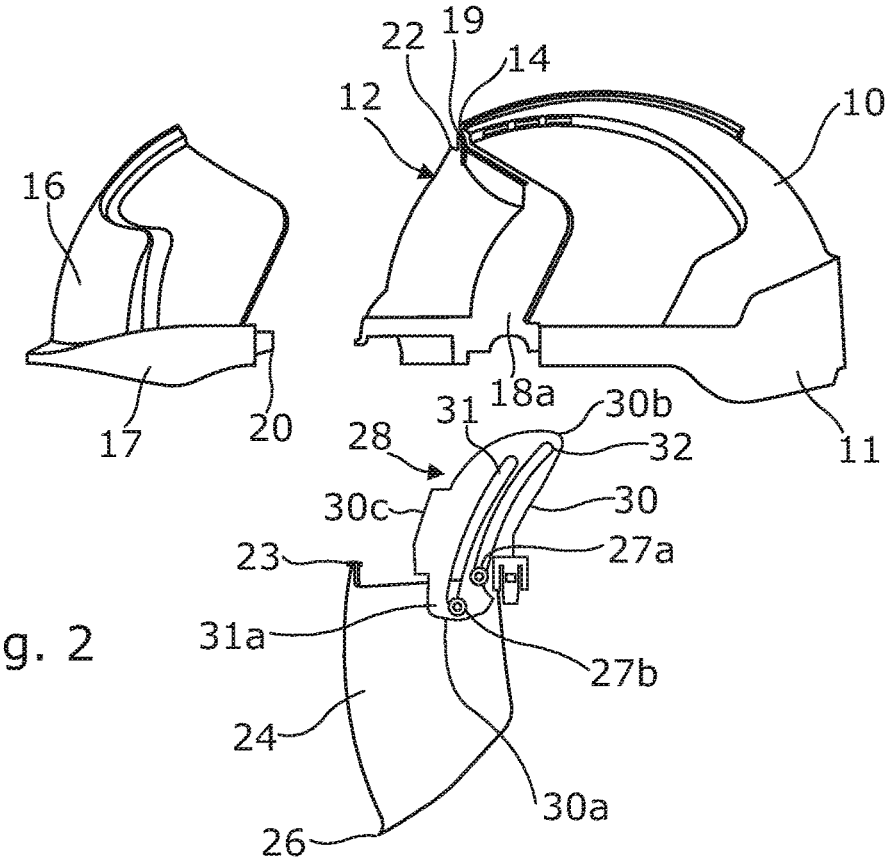
FIG. 2 is an exploded side view of the safety helmet of FIG. 1A.
Figure 1B:
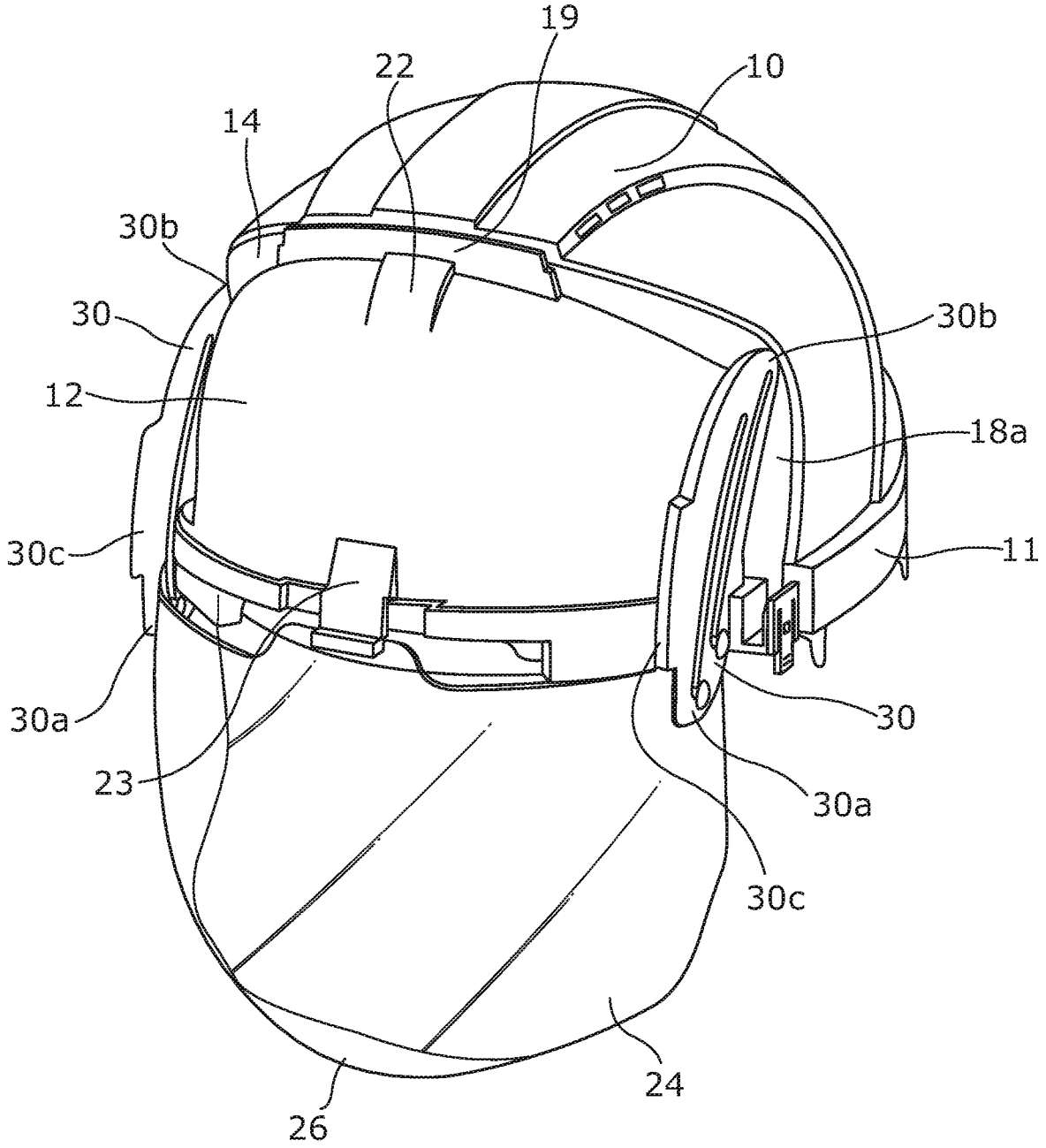
FIG. 1B is a front perspective view of the safety helmet of FIG. 1A, with the front cover removed.

FIGS. 1A, 1B, and 2 show a safety helmet comprising a hard outer shell 10 which is generally dome-shaped so as to fit on the crown of a user's head. The rim 11 of the shell 10 is generally oval in shape. The shell 10 may be constructed of a plastics material, typical of such safety helmets, although it will be appreciated that the shell 10 may be constructed of any suitable material as will be apparent to those skilled in the art and the present invention is not necessarily intended to be limited in this regard. The safety helmet has a rear portion and a recessed front portion 12, when oriented for use. The front portion 12 comprises just a segment of the whole shell 10, and is also dome-shaped but has a smaller radius of curvature than the rest of the shell 10 such that a stepped edge 14 is formed where the front portion 12 meets the rest of the shell 10, the front portion thus defining a recessed portion relative to the rest of the body of the shell 10.

A snap-lock 22 near the apex of the stepped edge 14 is provided for temporary engagement with a visor, when in use. In the present example, the snap-lock 22 is formed in the surface of the recessed portion and comprises a ramp located generally centrally thereon. A dip is provided at the peak of the ramp. Use of the snap-lock in relation to other features of the safety helmet is described below.

The safety helmet further comprises a cover portion 16 which can be mounted over the recessed front portion 12. The cover portion 16 has a larger radius of curvature than the front portion 12, such that a cavity 18 is defined between the cover portion 16 and the recessed front portion 12 of the safety helmet when the cover portion 16 is mounted over the front portion 12. The recessed front portion 12 is indented at its side edges such that, when the cover portion 16 is mounted over the front portion 12 and a cavity 18 is defined between the cover portion 16 and the front portion 12 as described above, a pair of channels 18*a* is defined, each channel 18*a* being disposed at a respective side of the cavity 18. The cover portion 16 is shaped and configured to follow a similar radius of curvature to the rear portion of the shell 10, such that when the two are fitted together a continuous helmet shape is defined. The cover portion 16 comprises a rim 17 having a curve which follows the curvature of the rim 11 of the shell 10.

The cover portion 16 comprises a plurality of engagement mechanisms configured to secure the cover portion in place at the front of the safety helmet. In particular, there are projections 20 near the rim 17 of the cover portion on either side which extend in the same direction as the rim 17 and include a saw-shaped tooth at their distal ends. The projections 20 engage with sockets (not shown) in the stepped edge 14 of the outer shell 10 and secure the cover portion 16 to the shell 10. Additionally, a snap-fit mechanism 19 at the apex of the stepped edge 14 secures the upper parts of the cover portion 16 and the shell 10 together. Other suitable engagement mechanisms are possible and the present invention is not necessarily intended to be limited in this regard. The safety helmet further comprises a transparent visor in the form of a faceshield 24 secured within the cavity 18. The faceshield 24 is formed of a curved piece of transparent material substantially large enough to fully cover the face of the wearer, when in use. The material should be hard enough to protect the wearer from flying particulates and debris which might otherwise strike the wearer and cause damage or irritation. FIGS. 1 and 2 illustrate the faceshield 24 in the operable position, in which the faceshield 24 extends from the cavity into an area which would effectively cover the wearer's face during use. In the operable position, the faceshield 24 is angled or oriented so that the part of the faceshield adjacent the wearers eyes is generally perpendicular to the wearers eyeline. The faceshield 24 is curved along its lateral axis, so that the faceshield 24 protects the side of the wearers face during use. Additionally, the faceshield has a curve along its longitudinal axis, which matches the curve of the cavity 18 (defined by the curvature of the cover portion 16 and the front portion 12 of the shell 10). At the lower edge of the faceshield 24 a tab 26 is formed which extends outwardly away from the wearers face, in use.

At the upper edge of the faceshield 24, a snap-clip 23 is provided for temporary engagement with the snap-lock 22 on the recessed portion of the outer shell 10. In the present exemplary embodiment, the snap-clip 23 comprises a bendable protrusion having a rounded lip. The rounded lip is configured to slide along the surface of the recessed portion, during use. This mechanism will be described in further detail hereinafter.

A pair of engaging lugs 27 is provided near the upper edge of the faceshield 24 on either side of the faceshield 24. The individual engaging lugs of a pair 27 are spaced laterally and longitudinally from each other. A first lug 27*a* of each pair is located at a respective side of the faceshield 24, at or near the corner defined between its top and respective side edges. A second lug 27*b* of each pair is located at a respective side of the faceshield 24, but lower than the first engaging lug 27*a*, and a short distance further toward the front of the faceshield 24, such that the first and second engaging lugs 27*a*, 27*b* can be said to be "diagonally" spaced apart. The engaging lugs 27*a*, 27*b*, extend outwardly from the faceshield 24 in a direction perpendicular to its surface, have a length that is less than the width of the channels 18*a*, and are generally circular in cross-section. The distal end of each engaging lug 27*a*, 27*b*, is terminated by a stopper that is generally circular in shape and has a shallow domed profile. The diameter of the stopper is larger than the cross-sectional diameter of the respective engaging lug 27*a*, 27*b*.

A pivot mechanism 28 is removably mounted within each channel 18*a*. In this particular embodiment of the present invention, the pivot mechanism 28 comprises a pair of plates 30, each plate 30 being fitted in a respective channel 18*a* on either side of the recessed front portion 12 of the shell 10. Each plate 30 is identical and so only one is described in detail.

The plate 30 is an elongate member having a first end 30*a* and a longitudinally opposing end 30*b*. The first end 30*a*, which can be considered the lower end relative to the helmet when oriented for use, has a generally straight edge of length less than the depth of the respective channel 18*a*. The second end 30*b* comprises a rounded peak. The side edges of the plate 30 are thus curved from a respective end of the straight edge at the first end 30*a* to the rounded peak at the second end 30*b*. The curved edge that sits adjacent the front portion 12 is convex and generally follows the curvature of the front portion 12. The opposing side edge is concave and has a radius of curvature greater than that of the other side edge. The convex edge comprises a flange 30*c* which juts from the edge of the plate 30. The flange 30*c* has a slightly curved leading edge which follows the curvature of the inner surface of the cover 16, and flat upper and lower edges substantially perpendicular to the leading edge so as to define a curved rectangular part. When the safety helmet is assembled, and the cover 16 affixed over the recessed portion 12, the leading edge of each flange 30*c* of each plate 30 abuts the inner surface of the cover, providing stability to both the cover 16 and to each plate 30.

The plate 30 is provided with a pair of curved channels or tracks 31, 32. The channels or tracks 31, 32 are of similar length and run alongside each other (in laterally spaced apart relation) for the most part, but they are longitudinally offset from each other such that an end of one of the tracks 31 (nearest the convex side edge of the plate 30) is closer to the first end 30*a* of the plate 30, whereas an (opposite) end of the other of the tracks 32 (nearest the concave side edge of the plate 30) is closer to the rounded second end 30*a* of the plate 30. The faceshield 24 is mounted on the pivot mechanism (and, therefore, the helmet) by means of the engaging lugs 27*a*, 27*b*, each lug 27*a*, 27*b* slidably engaging in a respective one of the tracks 31, 32. It can be seen from FIG. 2 for example that, so mounted, the each plate 30 is oriented side-on in a respective channel 18*a* such that the convex side edge thereof runs alongside the curve of the front portion 12 of the helmet shell, the second track 32 (nearest the concave side edge of the plate 30) is engaged by a first respective lug 27*a* (located near the corner of the faceshield 24) and the first track 31 (nearest the convex side edge of the plate 30) is engaged by a respective second lug 27*b*.

Although the tracks 31, 32 are curved and run generally parallel to each other (in laterally spaced apart relation), the radius of curvature of the first track 31 (nearest the convex side edge of the plate 30) is slightly greater than that of the respective second track 32. In the example illustrated, the first track 31 appears almost linear, whereas the curvature of the second track 32 generally follows the curvature of the adjacent concave side edge of the plate 30.

Thus mounted, each side edge of the faceshield 24 sits between the inner surface of a respective channel 18*a* nearest the recessed front portion 12 and the associated plate 30 with the lugs 27*a*, 27 extending through the tracks 31, 32 toward the opposing inner surface of the channel 18*a*. The cross-sectional diameter of the lugs 27*a*, 27*b* is slightly less than the width of the tracks 31, 32, but the diameter of the respective stoppers is greater than the width of the tracks, thus preventing the plate 30 and the faceshield from becoming disengaged once assembled.

Figure 3A:
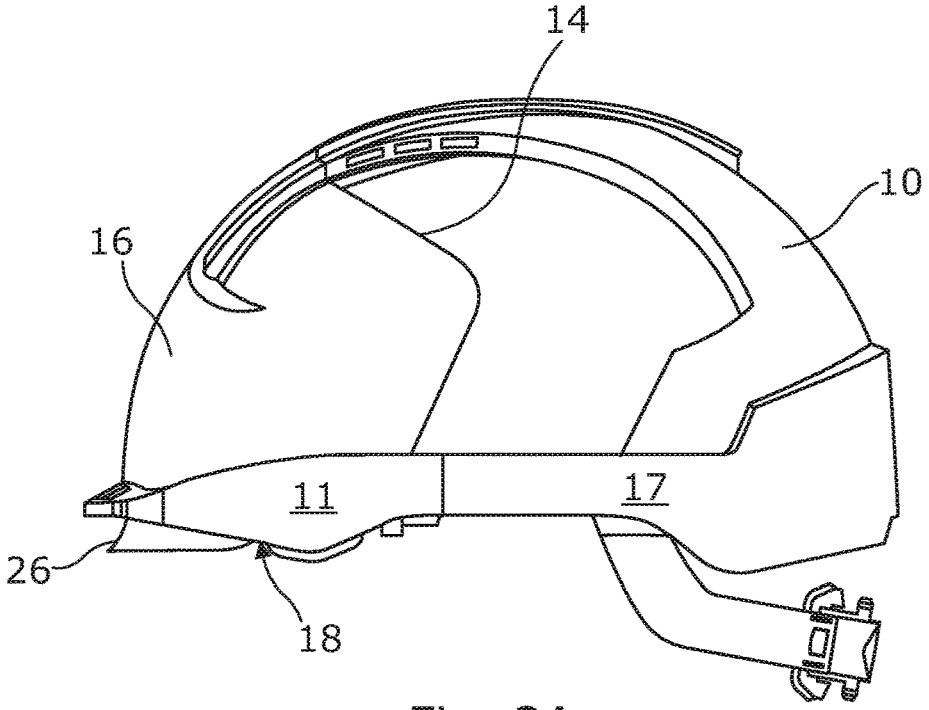
FIGS. 3A and 3B are side views of the safety helmet of FIG. 1A wherein the visor is in a retracted and operable position respectively.
Figure 3B:
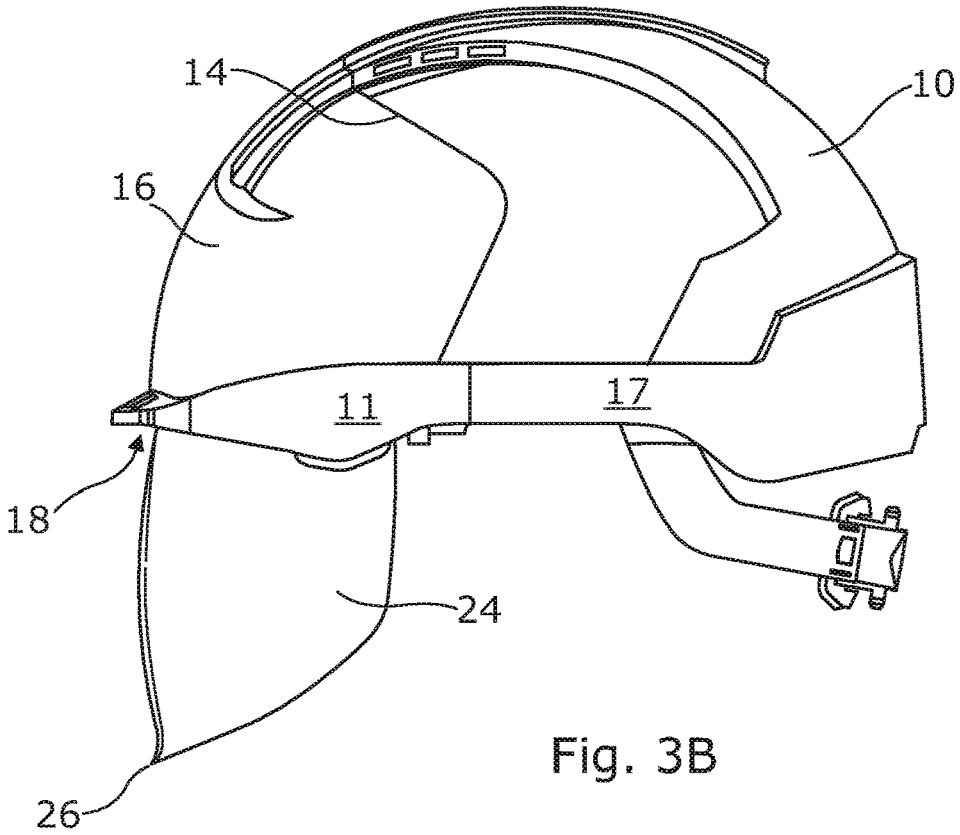

Referring now to FIGS. 3A and 3B of the drawings, when the safety helmet is fully assembled, the faceshield 24 is moveable between a first position wherein the faceshield 24 is fully retracted and disposed within the cavity 18, to a second position wherein the faceshield 24 is fully extended from the cavity 18. In the retracted position, the lip of the snap-clip 23 is engaged with the dip of snap-lock 22 of the stepped edge 14, positively locking the faceshield in that position (not visible in FIGS. 3A and 3B). As the user pulls the faceshield 24 downwardly (relative to the front portion of the helmet), the snap-clip 23 bends to allow the lip to disengage with the dip of the snap-lock, and engaging lugs 27*a*, 27*b* (also not visible in FIGS. 3A and 3B) slide downwardly along the respective tracks 31, 32. The slight curve of the tracks 31, 32 allow the faceshield 24 to slide out of the cavity 18, following the curvature of the recessed front portion 12. In the position shown in FIG. 3B of the drawings, the faceshield 24 is tilted slightly forward, because its profile follows the curvature of the recessed front portion 12, thus providing improved clearance between the wearer's face and the faceshield, when in use, compared with prior art solutions. Indeed, as a user pulls the faceshield 24 downwardly from the fully retracted position shown in FIG. 3A of the drawings, the line of travel generally follows the curvature of the recessed front portion 12, such that the user can place the faceshield 24 in the fully extended and operable position shown in FIG. 3B without it colliding with a user's eyeglasses or nose, for example.

Figure 4C:
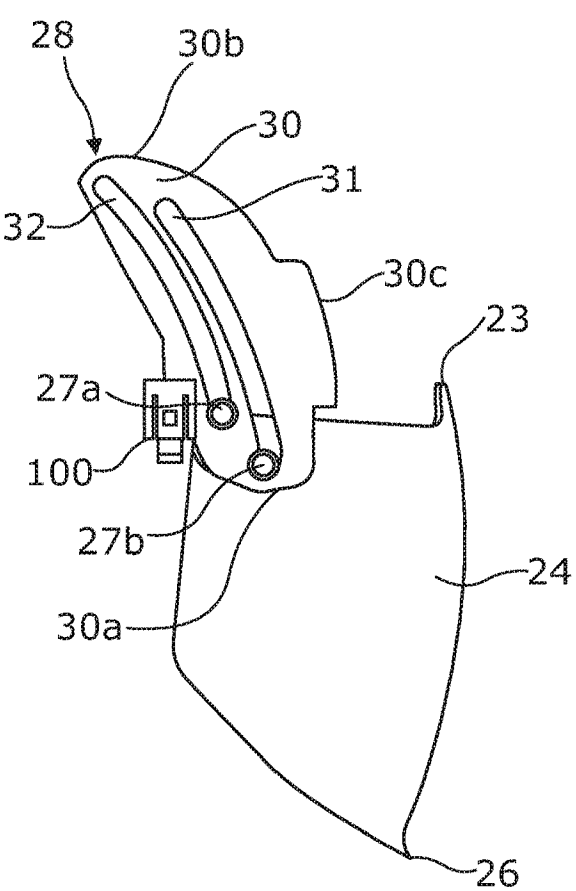
FIGS. 4A to 4C are side views of the visor of the safety helmet of FIG. 1A in a retracted, tilted and operation position respectively.
Figure 4B:
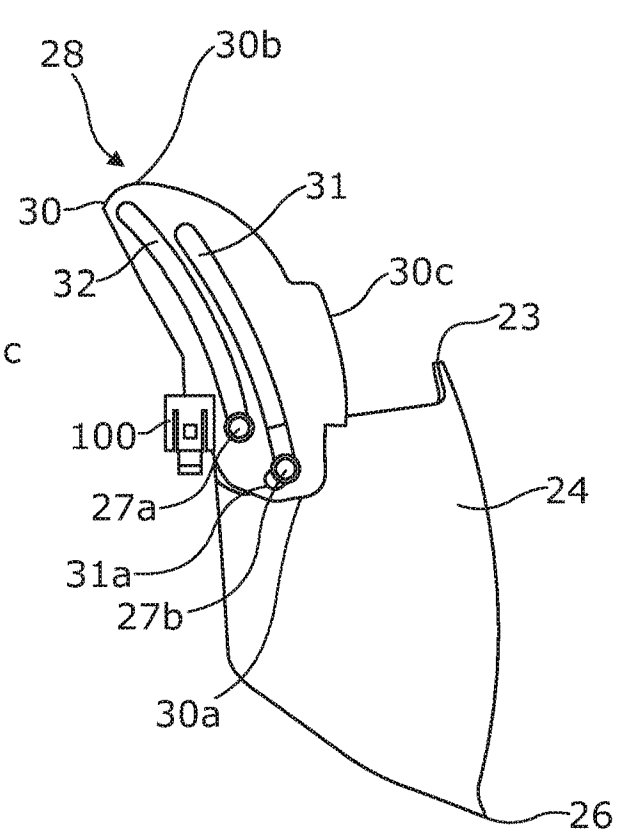
Figure 4A:
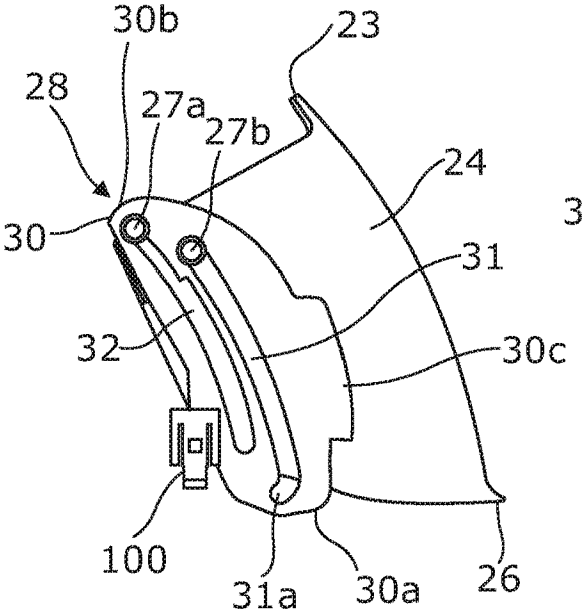

FIGS. 4A to 4C illustrate the pivot mechanism 28 and faceshield 24 assembly schematically without the helmet. As can be seen in FIG. 3A, the first track 31 (nearest the convex side edge of the plate 30) terminates (adjacent the straight-edged first end 30*a* of the plate 30) with an offset track portion 31*a*. The offset track portion 31*a* is slightly curved and angled, relative to the main track, toward the concave side edge of the plate 30. Thus, the first track 31 has a main portion having a uniform first (relatively large) radius of curvature, and a terminating second portion, namely the offset track portion 31*a*, which is relatively short compared with the overall length of the track 31, and which is integrally connected to the main portion of the track but which has a much smaller radius of curvature so as to form an elbow-like angled portion at the end of the track 31. A mounting mechanism 100 is provided at the concave side edge of the plate 30, to enable the assembly to be removably mounted within the channels 18*a* of the cavity 18.

FIG. 4A schematically illustrates the assembly with the faceshield 24 in the fully retracted position, in which it is substantially wholly disposed within the cavity 18 defined between the front portion 12 of the helmet and the cover portion 16, except for a small peaked portion or tab 26 provided at the lower edge of the faceshield 24 which remains accessible, in use, below the lower edge of the cover portion 16 of the helmet to enable a user to manually extend the faceshield 24 to an operable position by gripping the peaked portion or tab 26 between their fingers and thumb and pulling. In the fully retracted position, and when the helmet is oriented for use, the engaging lugs 27*a*, 27*b* are located immediately adjacent the ends of the respective tracks 31, 32, nearest the rounded second end 30*b* of the plate 30.

Referring to FIG. 4B, as the user pulls the faceshield 24 out of the cavity 18 (by gripping the peaked portion or tab 26 of the faceshield 24 and pulling, as described above), the tracks 31, 32 slide along the respective lugs 27*a*, 27*b*, until the lug 27*a* in the second track 32 reaches its end, and the lug 27*b* in the first track 31 reaches the elbow-like feature defined between the main portion of the track 31 and the offset track portion 31*a*. During this process, the line of travel of the faceshield 24 generally follows the curvature of the front portion 12 of the helmet, such that sufficient clearance is provided to accommodate the user's eyeglasses or nose, for example.

Once the faceshield 24 has travelled to the position illustrated in FIG. 4B, the user can pull the faceshield 24 toward them such that it pivots about the first engaging lug 27*a* and the offset track portion 31*a* travels over the second lug 27*b*, thereby bringing the faceshield 24 to a position substantially perpendicular to the user's eye-line. Thus, the pivot mechanism 28 of this exemplary embodiment of the present invention provides the additional advantageous feature of providing adequate clearance during movement of the faceshield 24 from the fully retracted position to an operable position, whilst also enabling the optical and visual performance of the faceshield to be optimised, in use.

Furthermore, the pivot mechanism is mounted within the cavity 18, and fully retained therein at all times during use. This means that no holes are required to be made in the outer shell of the helmet, thereby enabling it to be configured to pass the so-called "Electrical Test". The pivot mechanism/faceshield assembly described above is also configured to be removable from the helmet if not required for use. The mounting mechanism 100 may be configured to clip onto a moulded feature within the channel 18*a* such that no metal rivets or other connecting means are required.

Furthermore, having the faceshield 24 assembly substantially completely retained within the cavity 18 when not in use (best seen in FIG. 3A of the drawings), has the advantage of protecting the faceshield 24 during storage, from minor abrasions and scuffs when being stored and transported, or from impact damage from being dropped, etc. As such the lifetime of the faceshield 24 can be significantly extended.

In one embodiment, the track 31 (or, more specifically, the offset track portion 31*a*) may be configured to allow the user to select one of a number of angular positions of the faceshield 24 (for use) between the angle defined by the curvature of the front portion 12 of the helmet (when the lug 27*a* is located at the "elbow" feature, as illustrated in FIG. 4B), and the vertical position (when the lug 27*a* is located at the end of the offset track portion 31*a* and the faceshield 24 is perpendicular to the user's eye-line, as illustrated in FIG. 4C). The offset track portion 31*a* may be provided with one or more notches, or similar features, each notch effectively defining an angle of the faceshield 24 relative to the user's face, in use. Thus, the rake of the faceshield 24 can be adjusted by moving the faceshield 24 along the offset track portion 31*a* to the desired position. The faceshield 24 can be locked in an angular position (i.e. at a desired rake) by the respective notch in the offset track portion 31*a* providing resistance to movement against the second engaging lug 27*b*. That resistance can simply be overcome by a greater manual force to move the faceshield 24 as desired. Thus, the user is provided with improved adaptability and comfort, in use.

Figure 5A:
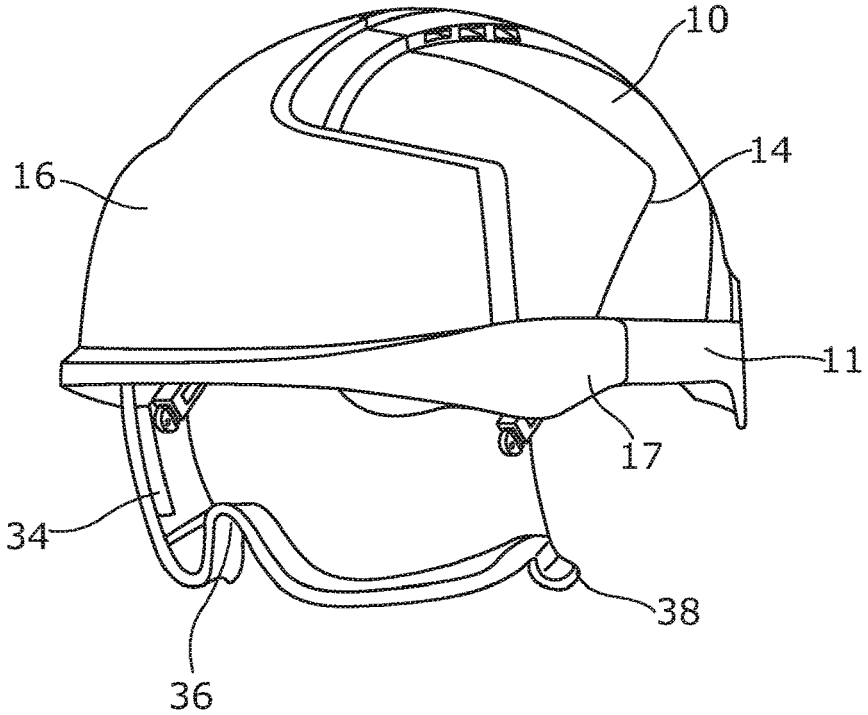
FIG. 5A is a front perspective view of another safety helmet having an integrated visor.
Figure 6:
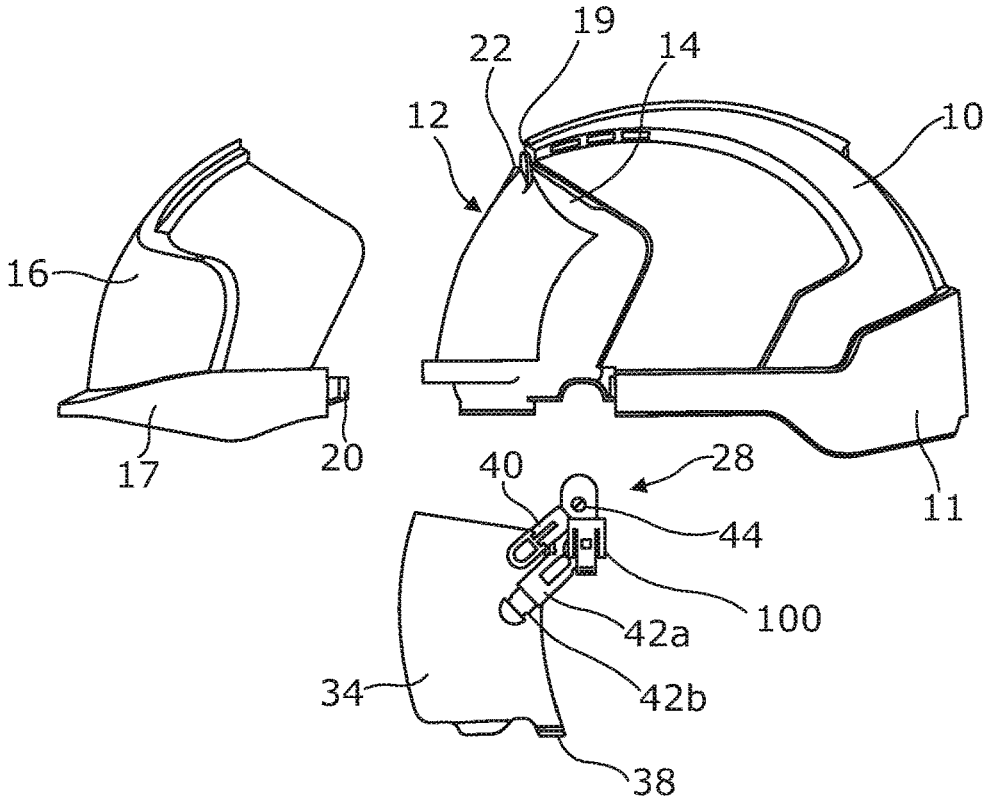
FIG. 6 is an exploded side view of the safety helmet of FIG. 5A.
Figure 5B:
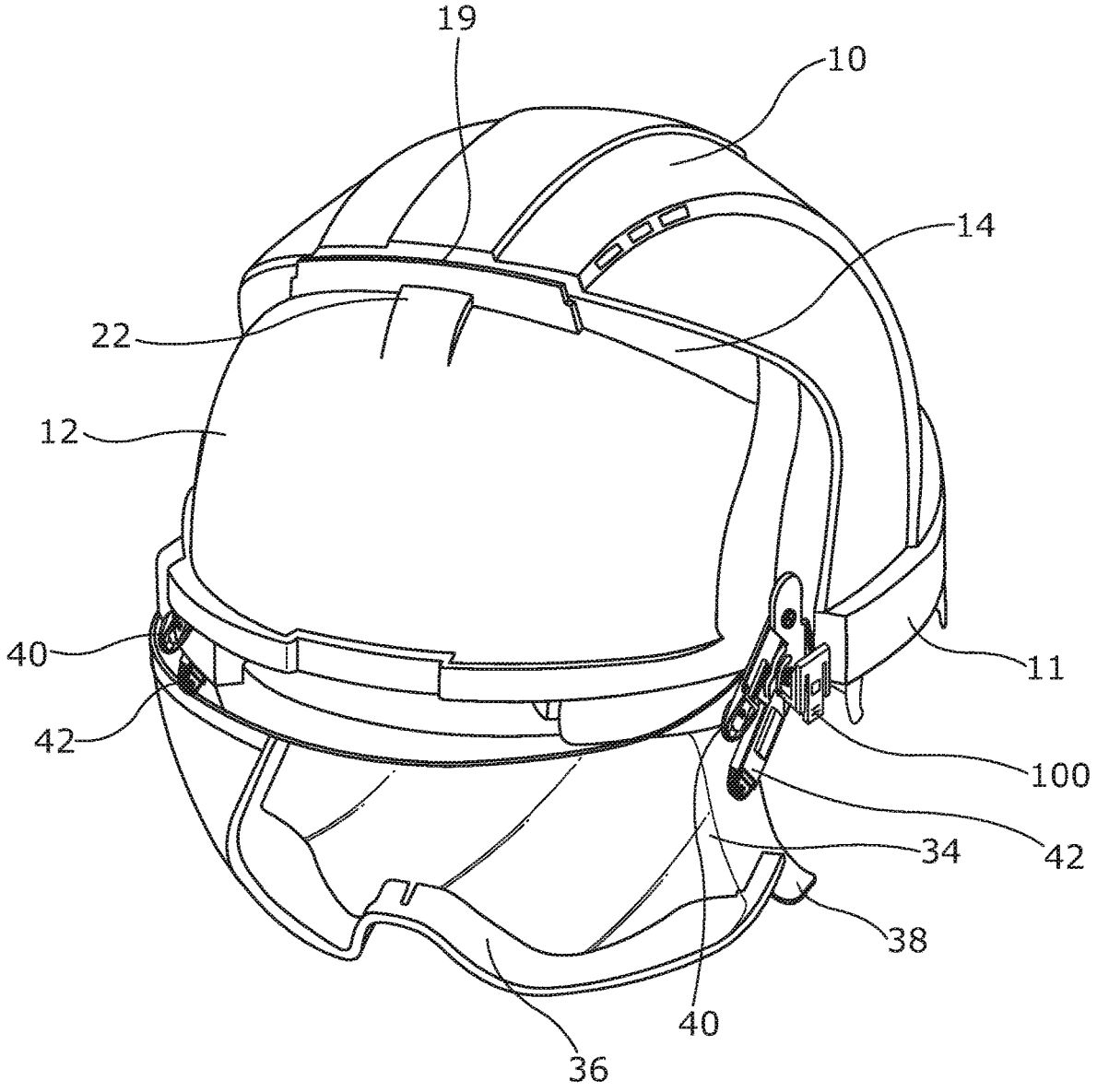
FIG. 5B is a front perspective view of the safety helmet of FIG. 5A with the front cover removed.

Referring now to FIGS. 5A, 5B and 6, an alternative embodiment of a safety helmet comprises the same outer shell 10 and cover 16 parts as the previous embodiment described with respect to FIGS. 1 to 4C. The description of those parts are not be repeated here, and the reference numerals for the same parts are repeated where appropriate.

The outer shell 10 and cover 16 engage as previously described, fitting together to define a cavity 18 by means of engagement mechanisms. Channels 18*a* are defined on either side of the cavity 18 to accommodate a removably mountable pivot mechanism described below. In this case, the safety helmet further comprises a transparent visor in the form of an eyeshield 34 mounted to the helmet via the pivot mechanism 28. The eyeshield 34 comprises a single piece of moulded transparent plastics material having a generally triangular nose bridge portion 36 disposed substantially centrally along the lower edge. The nose bridge portion 36 is configured to rest on the wearers nose during use, and may comprise a portion of soft material for comfort. Toward one of the outer edges of the eyeshield 34 there is a tab 38 which the user can hold to move the eyeshield 34 between the fully retracted and fully extended operable positions, as is described below.

The eye shield is connected to the rest of the safety helmet by means of a pair of pivot mechanisms 28, one on either side of the recessed portion 12 of the outer shell and removably mounted within a respective channel 18 as before. Each pivot mechanism 28 is identical and so only one will be described in detail. In this example, the pivot mechanism is a double arm pivot mechanism. This double arm pivot mechanism comprises an upper arm 40 and a lower arm 42. Each arm 40, 42 is pivotally coupled at one end to a fixed plate 44. The pivotal couplings of the arms 40, 42 to the plate 44 are longitudinally spaced apart, and may comprise pins or other known pivotable connection means.

The 'lower' arm 42 is telescopic to allow for extension and contraction. The 'upper' arm 40 (when the assembly is mounted and oriented for use) is not telescopic. The arms 40, 42 connect to the eyeshield 34 at two points vertically aligned with, and spaced apart from, each other. The plate 44 is fixedly (but removably) fitted within a respective channel 18*a* by means of a mounting mechanism 100, as before.

Referring additionally to FIGS. 7A, 7B, 8A, 8B and 8C, the eyeshield 34 may be moved between a fully retracted position (illustrated in FIGS. 7A and 8A), wherein the eyeshield 34 is completely retained within the cavity 18 of the safety helmet, save for the tab 38. The user may then exert force on the tab 38 in order to pull and extend the eyeshield 34 to the operable position (illustrated in FIGS. 7B and 8B). In this configuration, the eyeshield 34 extends from the cavity to a space in front of the wearer's eyes. The nose bridge portion 36 can rest on the nose bridge of the wearer. The surface of the eyeshield 34 remains substantially perpendicular to the eyeline of the wearer.

Figure 8C:
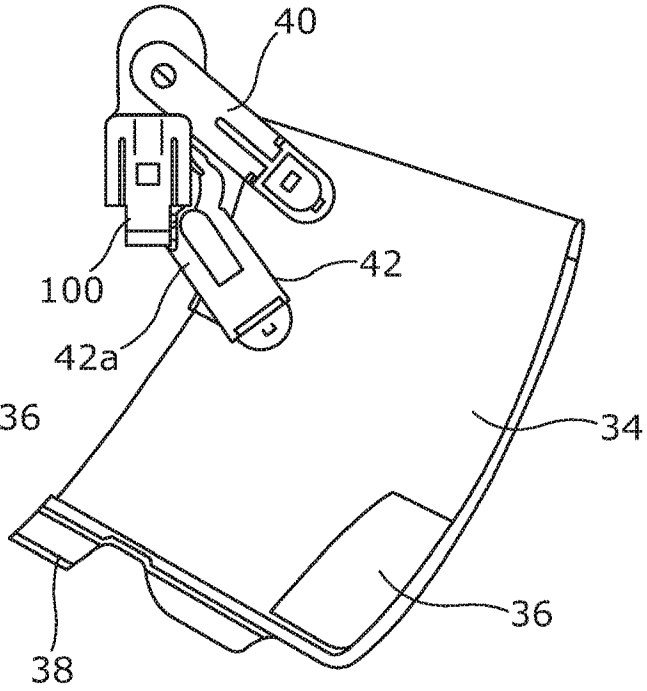
FIGS. 8A to 8C are side views of the visor of the safety helmet of FIG. 5A in a retracted, operable and raked position respectively.

Once the eyeshield 34 is in the operable position, the wearer may tilt the eyeshield 34 according to their requirements for comfort and/or better vision through the eyeshield 34, by gripping the tab 38 and moving it toward and away from their face. Referring specifically to FIG. 8C of the drawings, the telescopic nature of the lower arm 42 allows the eyeshield 34 to pivot about the point where the upper arm 40 connects to the eyeshield 34. Therefore the angle relative to the wearer, or the rake, of the eyeshield 34 can be manually adjusted to suit the needs of the wearer, as will now be described in more detail.

Figure 7A:
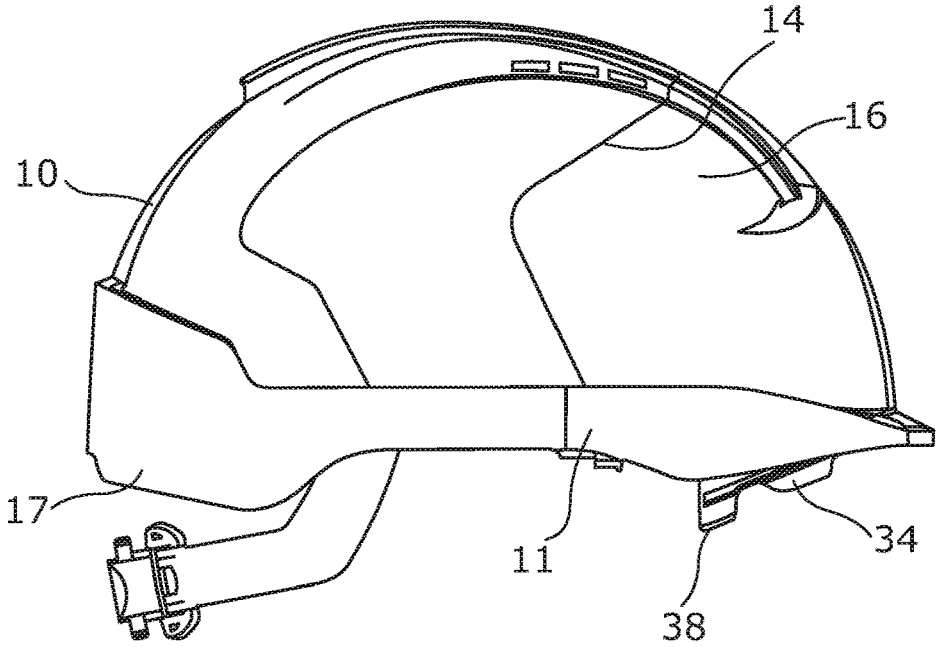
FIGS. 7A and 7B are side views of the safety helmet of FIG. 5A wherein the visor is in a retracted and operable position respectively.
Figure 7B:
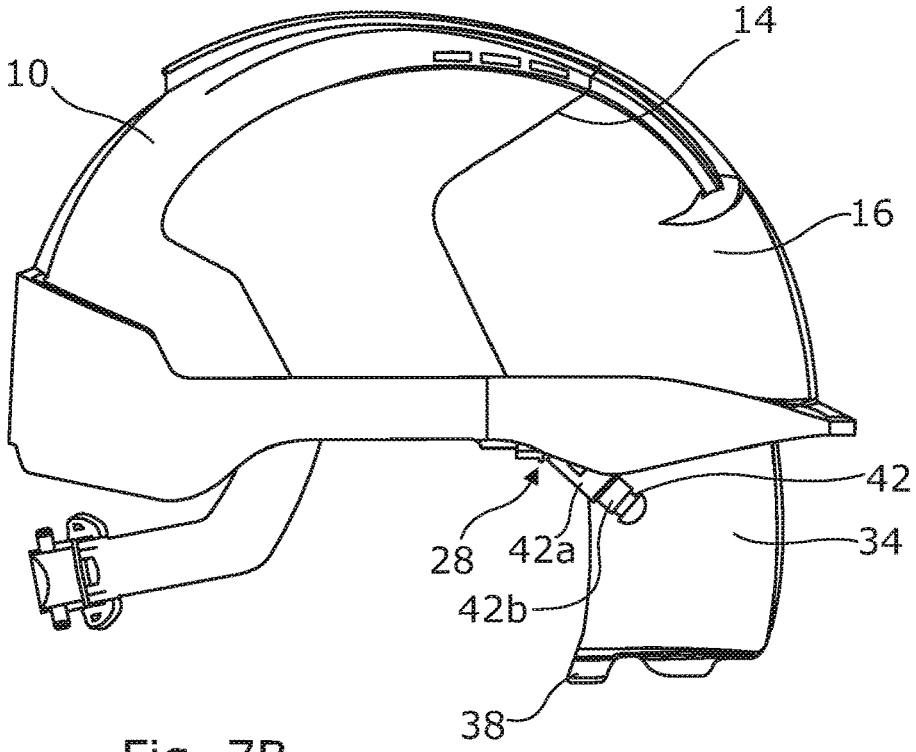
Figure 8B:
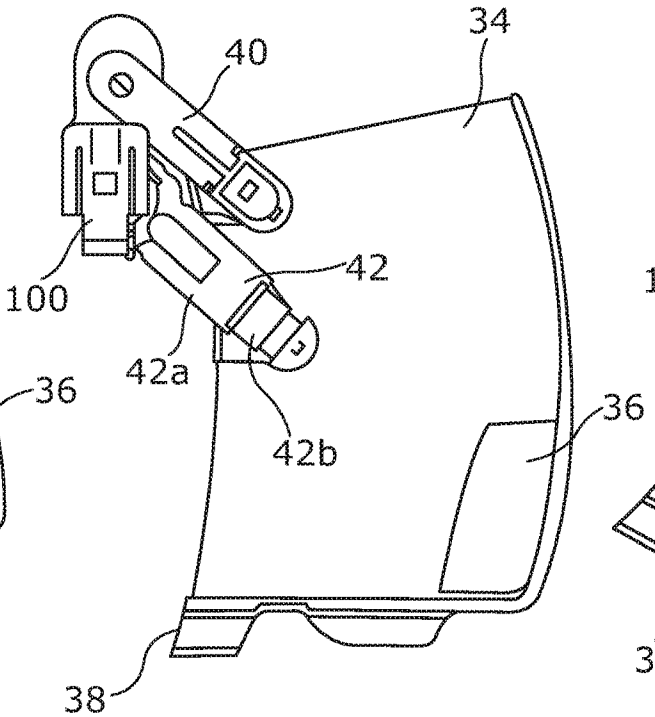
Figure 8A:
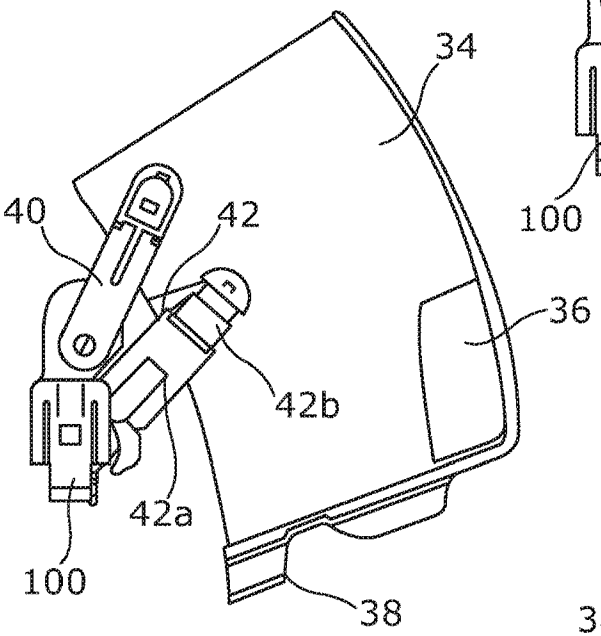

In the fully retracted position, as shown in FIGS. 7A and 8A, the pivot mechanisms 28 are wholly disposed within respective channels 18*a* and the eyeshield 34 is substantially wholly disposed within the cavity 18 at the front of the helmet, save for the tab 38 which remains accessible below the lower rim of the cover portion 16 of the helmet.

The first arm 40 is pivotally coupled at one end to the plate 44 and fixedly connected at the other end to a side portion of the eyeshield 34, close to the upper corner formed between the upper and respective side edges, with reference to the assembly when correctly oriented for use. The second arm 42 is telescopic and comprises at least two arm portions: an outer arm portion 42*a* and an inner arm portion 42*b*, the inner arm portion 42*b* being longitudinally slidably mounted within the outer arm portion 42*a* to provide telescopic functionality. One end of the outer arm portion 42*a* is pivotally coupled to the plate 44, and the exposed end of the inner (or innermost) arm portion 42*b* is fixedly connected to a side portion of the eyeshield 34, below the end of the first arm 40.

When the eyeshield 34 is in the fully retracted position, the angle of the first arm 40, relative to a notional horizontal axis, may be around 45°, whereas that of the outer arm portion of the second arm 42 may be a little less to accommodate the two arms 40, 42, although the present invention is not necessarily intended to be limited in this regard.

In order to move the eyeshield 34 to an operable position, the user grasps the tab 38 and pulls. The eyeshield 34 thus extends out of the cavity 18 under manual force, following a line of travel of curvature substantially similar to that of the front portion 12 of the helmet (rather than straight down), thus providing clearance for a user's eyeglasses, for example. During this operation, the first arm 40 pivots relative to the fixed plate 44, having a maximum angle of rotation of around 90°. Thus, it reaches a limit of rotation when the longitudinal axis of the eyeshield 34 is substantially perpendicular to the user's eyeline, as shown in FIG. 8B. At this point, the arms 40, 42 are substantially parallel to each other. The nose bridge portion 36 may rest on the bridge of the user's nose. The user can leave the eyeshield 34 in this position if required. However, additional adaptability is provided by the telescopic arm 42 in that, from the position shown in FIG. 8B, the eyeshield 34 can be pulled toward the user's face, contracting the telescopic arm 42 and adjusting the rake of the eyeshield relative to the user's face, as shown in FIG. 8C. Thus, the user can adjust the eyeshield 34 for comfort. Some form of locking or engaging mechanism may be provided to facilitate a plurality of distinct degrees of rake and/or tilt and any suitable manner.

As with the prior embodiment, the visor (eyeshield 34) and pivot mechanism 28 (double arm pivot mechanism) is retained within the cavity when not in use. Therefore, the eyeshield 34 is protected during storage and transit from minor abrasions or scratches, thus improving the longevity of the product. By mounting the pivot mechanism within channels defined by the cavity 18, it is envisaged that a safety helmet according to an embodiment of the invention could be configured to pass the so-called Electrical Resistance test, which requires that there are no holes or metal fixings on the outer shell of the helmet.

In both embodiments of the invention described above, the visor is positively locked into its operable position. The angled portion of the foremost track 31 of the first exemplary embodiment means that the projections are guided into the operable position. An external force is required to push the foremost engaging lug 27*b* out of the angled portion of the first track 31. Similarly, the connected nature of the double arm pivot mechanism means that during transition between the fully retracted position and the operable position, the arms are pulling on each other toward one direction or the other. The retracted positions and operable positions are points of equilibrium for the system. By enabling the pivot mechanisms to be pivotable themselves, the wearer may then adjust the visor according to their requirements, thus improving the comfort of the safety helmet which is particularly advantageous when the helmet is being worn for an extended period of time.

In both embodiments, a key feature of the invention is that there are two distinct directions of travel of the visor possible, in order to provide functionality and adaptability for the user: the first direction of travel incorporates a line of curvature that generally follows the curvature of the front portion of the helmet, such that the visor is extended with enough clearance to accommodate a user's glasses and/or nose; a second line of travel, when the visor is fully extended enables the lower end of the visor to be pulled or pushed toward the user's face, thus enabling the rake of the visor to be adjusted for comfort.

Furthermore, both embodiments of the present invention fully contain the visor within the cavity 18 when the visor is in the fully retracted position, save for the gripping portions formed by the lip 26 and the tab 38 respectively. The visor is protected as already described.

In either of the above described embodiments of the invention, and with reference to FIGS. 2 and 6, the cover 16 may be removably fitted to the helmet once assembled. This provides the advantage of enabling the visor to be replaced in the event that damage should occur to the visor during its usable lifetime. In this way, the lifetime of the safety helmet itself is extended, as the user is not required to replace the whole helmet should the visor become unusable or damaged irreparably. Additionally, because the outer shell 10 and cover 16 are the same for both embodiments of the invention, a user may swap between a faceshield 24 and an eyeshield 34 for the same safety helmet. This reduces the need to purchase and carry two safety helmets, and provides the user with more adaptability.

In some embodiments, additional features may be added to the safety helmet, for example ear defender portions suitable for blocking out loud noises. It will be appreciated by those skilled in the art that the eyeshield 24 may be used with the elongate track pivot mechanism, and similarly the faceshield 34 may be used with the double arm pivot mechanism. The visor may be tinted.

Figure 9:
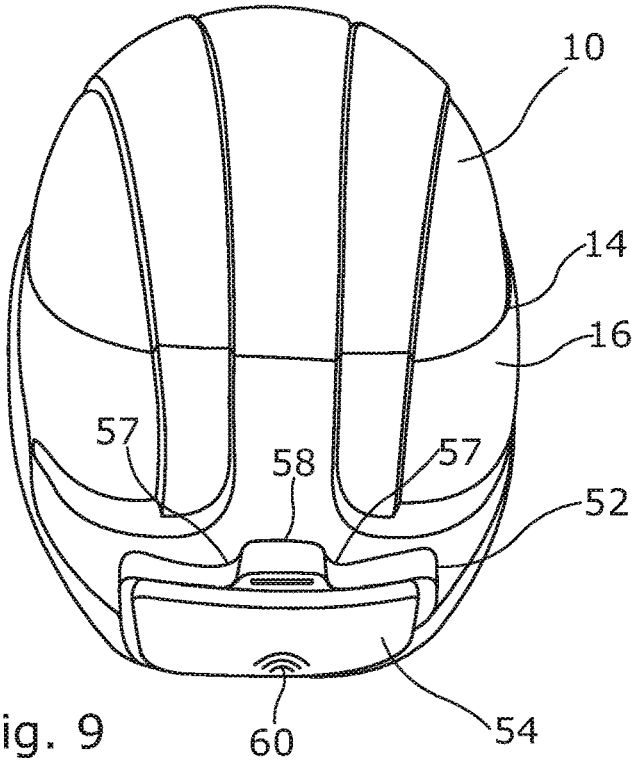
FIG. 9 is a front view of another safety helmet.
Figure 10:
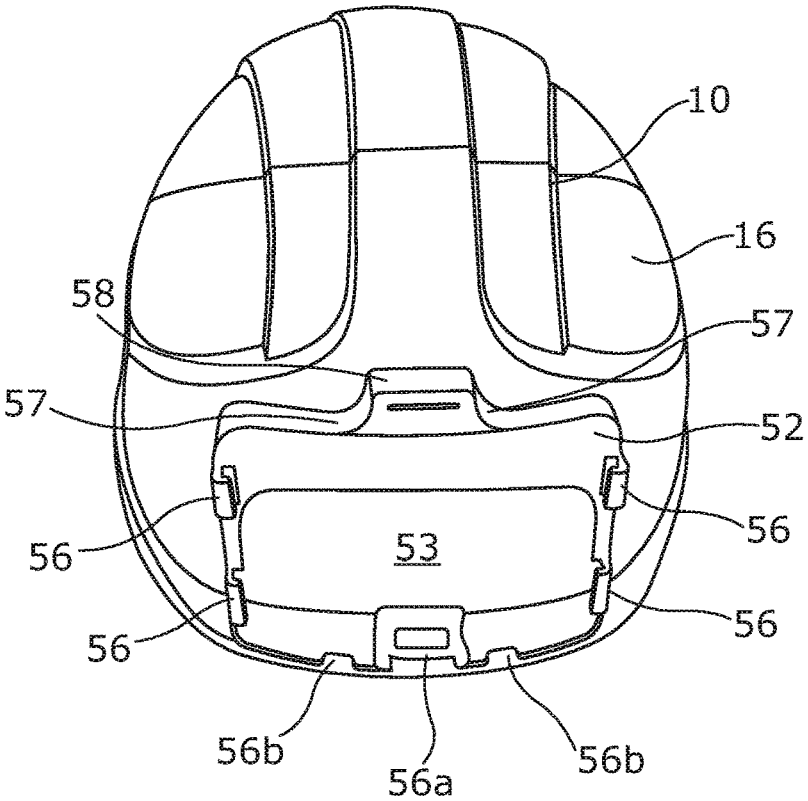
FIG. 10 is the safety helmet of FIG. 9, showing the card holder open.

Referring now to FIGS. 9 and 10, the front cover 16 of the safety helmet includes a generally rectangular card holder 50 which is secured at a central position of the cover 16. The card holder 50 is curved so as to follow the profile of the cover 16.

The card holder 50 comprise a mount 52 and a cover 54. The mount 52 and cover 54 may be formed of a plastics material in a single moulded piece or part. Alternatively, other suitable are possible and the invention is not limited in this regard.

The mount 52 comprises a generally rectangular frame comprising four edges, namely an upper, lower, left-hand and right-hand edge, and defining a generally rectangular window 53 therein. Sockets 56 are located on the lower and side edges of the frame. In this exemplary embodiment, the left-hand and right-hand sides of the frame comprise two sockets 56 which extend generally perpendicularly to the surface of the cover 16, positioned either side of a central point on the side edge and spaced longitudinally from each other. The lower edge of the frame comprises a single large socket 56*a* positioned centrally along the lower edge, and a pair of smaller sockets 56*b* spaced either side of the large socket 56*a*. The large socket 56*a* is suitable for retaining the cover 54 within the frame of the mount 52, while the two smaller sockets 56*b* are configured to help locate the cover 54. The large socket 56*a* comprises a generally rectangular aperture configured for receipt of a tooth, lip or other such feature, to engage therewith for the purposes of locking two parts together. The side sockets 56 keep the cover against the mount 52 when the safety helmet is oriented for use.

The upper edge of the frame is shaped to define two grip portions 57 either side of a central projection 58. The projection 58 extends from the upper edge of the frame in a direction generally parallel to the surface of the cover 16 and lies flush with that surface. The grip portions 57 are configured to be suitable for placement of fingers of the user, in use. The grip portions 57 allow the user to gain purchase on the mount 52, and apply downward pressure thereto.

The mount 52 is welded onto the cover portion 16 of the safety helmet described with reference to FIGS. 1 to 8C. Specifically, the mount 52 is welded on using an ultrasonic welding technique. The advantage of this is that there are no rivets or bolts extending through the cover portion 16 and into the cavity 18 of the safety helmet. As such, the cavity 18 can be kept to a minimum thickness therefore keeping the safety helmet size the same. Additionally, no through-holes or apertures are formed in the outer surface of the safety helmet as a whole and therefore this allows the helmet to continue to comply with the so called 'Electrical Resistance' test.

The cover 54 comprises a slightly curved rectangular part also having an upper, lower, left-hand and right-hand edges and is solid between those edges. In some exemplary embodiments, the cover may also comprise a window between its edges, optionally having a transparent part to fit within the window, so as to allow vision of the contents of the card holder from external viewers. At the lower edge of the cover 54 there is a textured portion 60 located generally centrally. The textured portion 60 allows the user to gain frictional purchase on the surface of the cover 54, and apply upward pressure thereto. This is important for reasons which will be described below.

Figure 11:
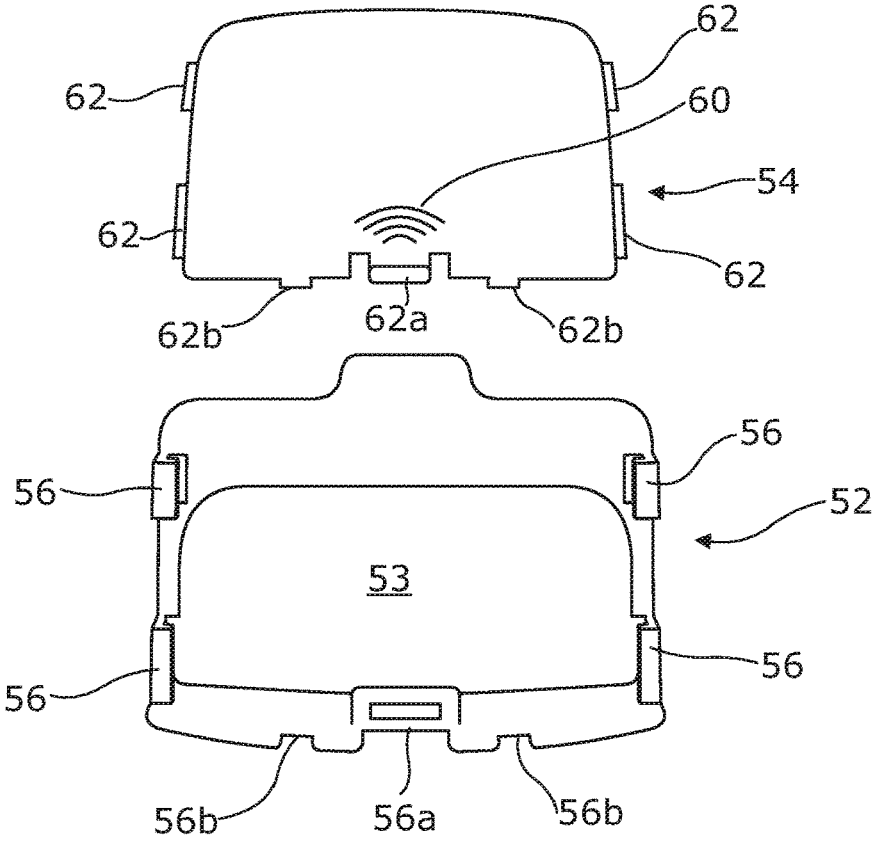
FIG. 11 is a plan view of the dissassembled card holder of the safety helmet of FIG. 9.
Figure 12:
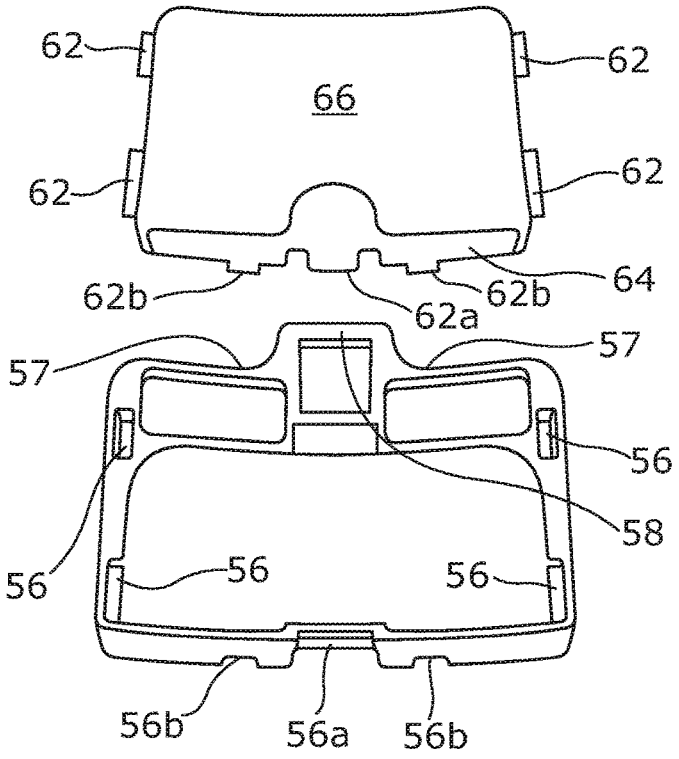
FIG. 12 is a rear view of the dissassembled card holder of the safety helmet of FIG. 9.

Referring additionally to FIGS. 11 and 12, the cover 54 comprises a plurality of engagement means 62 protruding from its left-hand and right-hand side edges, and also along its lower edge. The engagement means correspond positionally to the sockets 56 around the frame edge of the mount 52. As such, a pair of engagement means 62 are provided on each of the side edges, either side of a central point along the edge and spaced apart from each other. A large central engaging means 62*a* is positions along the lower edge with a small engaging means 62*b* positioned either side and spaced apart therefrom. The large engaging means 62*a* comprises a lip which is configured to engage with the aperture of the large socket 56*a*, this helps to lock the cover 54 within the mount 52.

Referring in particular to FIG. 12, the cover 54, as viewed from the rear, comprises a double wall structure, having a front wall 64 and a rear wall 66. The engaging means 62, 62*a*, 62*b* lie flush with the plane of the front wall 64 whilst the rear wall 66 comprises a generally semi-circular cut-out portion 68 along its lower edge (defined by the location of the large and small engaging means 62*a*, 62*b*). The rear wall 66 is spaced apart from the front wall 64 to define a gap therebetween. The two walls 64, 66 are connected by a side wall running along the top, left-hand and right hand edges of the cover 54. An opening 68 is therefore created along the entire lower edge of the cover 54.

In use, the cover 54 is slidably mounted within the mount 52. The user of the safety helmet may remove the cover 54 from the mount 52 with one hand by placing a pair of fingers either side of the central projection 58 on the mount 52, and a thumb or finger on the textured portion 60 of the cover 54. By applying pressure thereto and squeezing the fingers and thumb together, the wearer can overcome the frictional engagement between the engaging means 62 and the sockets 56, and remove the cover 54 from the mount 52. An Identity card, containing information regarding the wearer, any health information such as medication or allergies, the kind of job they are working on, addresses, contact numbers, etc. may be placed within the space between the double wall structure of the cover, via the opening 68.

Variations and modifications to the above described embodiments may be made without departing from the scope of the invention as defined in the appended claims.

The invention claimed is:

1. A safety helmet, comprising:

a head mountable shell defining a rear portion and a recessed front portion;

a cover portion for mounting over the recessed front portion so as to define a cavity; and a transparent visor mounted on the shell so as to be movable between a first position substantially within the cavity, and a second, operable position substantially at right angles to a user's eyeline;

wherein the visor is mounted across the recessed front portion by pivot mechanisms located at opposite sides of the recessed portion within the cavity; and each pivot mechanism comprises a pair of elongate cam tracks defined in a plate mounted in the recessed portion, and a pair of projections on the surface of the visor, such that each projection engages a corresponding cam track so as to slide along the corresponding cam track when the visor is moved between the first and second positions;

wherein the pair of elongate cam tracks are aligned so as to extend downwardly from near an upper end of the plate at an incline to the vertical, towards a lower end of the plate.

2. A safety helmet as claimed in claim 1, wherein the pair of elongate cam tracks comprises a first cam track laterally spaced forward of a second cam track.

3. A safety helmet as claimed in claim 2, wherein the cam tracks extend alongside each other and are longitudinally offset such that a lower end of the first track is closer to the lower end of the plate than the lower end of the second track, and an upper end of the second track is closer to the upper end of the plate than the upper end of the first track.

4. A safety helmet as claimed in claim 3, wherein the first track has a radius of curvature that is greater than that of the second track and wherein the first track comprises an angled portion at its lower end.

5. A safety helmet as claimed in claim 4, wherein the angled portion includes at least one notch defining a stop point for the corresponding projection to define a predetermined rake angles of the visor when in the second position.

6. A safety helmet as claimed in claim 1, wherein the plate of each pivot mechanism is removably mounted in the recessed portion.

* * * * *